United States Patent [19]

Bommart

[11] 4,313,382

[45] Feb. 2, 1982

[54] SETTING ARRANGEMENT FOR ALIGNMENT AND GAP BETWEEN TWO RAIL ENDS

[75] Inventor: Patrick Bommart, Rueil-Malmaison, France

[73] Assignee: C. Delachaux, S.A., Gennevilliers, France

[21] Appl. No.: 113,791

[22] Filed: Jan. 21, 1980

[30] Foreign Application Priority Data

Jan. 24, 1979 [FR] France ..... 79 01798

[51] Int. Cl.[3] ..... E01B 29/46

[52] U.S. Cl. ..... 104/1 R; 29/281.5; 104/15; 219/53; 228/49 R; 269/43

[58] Field of Search ..... 104/1 R, 2, 3, 15; 269/43; 254/43; 29/281.5; 219/53, 54, 55, 101; 228/49 R, 49 B

[56] References Cited

U.S. PATENT DOCUMENTS

| | | | |
|---|---|---|---|
| 3,726,232 | 4/1973 | Bryan, Jr. | 104/15 |
| 4,103,139 | 7/1978 | Zollinger | 219/101 |
| 4,176,777 | 12/1979 | Bommart | 254/43 X |
| 4,215,260 | 7/1980 | Zollinger | 219/53 |
| 4,236,453 | 12/1980 | Collen | 104/15 |
| 4,270,036 | 5/1981 | Zollinger | 219/53 |

FOREIGN PATENT DOCUMENTS

| | | | |
|---|---|---|---|
| 1271740 | 7/1968 | Fed. Rep. of Germany | 104/15 |
| 1478852 | 7/1977 | United Kingdom | 104/15 |

*Primary Examiner*—Randolph A. Reese

*Attorney, Agent, or Firm*—Parmelee, Miller, Welsh & Kratz

[57] ABSTRACT

An improved apparatus for aligning and setting the gap between two rail ends comprises a rigid housing overlapping the two rails and providing an access area around the two rail ends. A first pair of presses and a second pair of presses are mounted in line on the frame and arranged so that the first pair of presses is situated between the second pair of presses. Each combination of a first press and a second press serves to grip one of the two rails to be joined. A pair of vertically mounted jacks are operatively secured to the second pair of presses to provide vertical movement of the second pair of presses independent of the rigid housing. Vertically adjustable support stops engage the tops of the rails and together with the vertically adjustable second presses effect vertical adjustment of the rails. The improved apparatus can be mounted singly or in pairs on a gantry and can include gap setting apparatus and weld dressing apparatus.

7 Claims, 9 Drawing Figures

SETTING ARRANGEMENT FOR ALIGNMENT AND GAP BETWEEN TWO RAIL ENDS

The present invention concerns a device for adjusting the alignment and the gap size of two ends of rails for the purpose of connecting these two ends by fishplates or by welding, which also makes it possible to achieve fettling of the weld formed, in a case in which the connection of the two ends has been carried out by welding.

In the operations of joining of two ends of rails, in particular of railway rails, it is necessary to carry out an adjustment of the rails before joining them. Moreover, when the connection is carried out by welding, for example, by aluminum thermite welding, it is necessary after welding to carry out at least a partial and if possible total fettling of the weld bead formed.

The adjustment of the rails consists of adjusting the gap size between the two ends to be joined, of aligning the vertical inside faces of the rail heads which are to be connected, and to bend the ends slightly to raise them upwards, this bending being intended basically for joining by welding.

The fettling consists of eliminating the weld bead at least on the top and on both sides of the rail head and if possible over the whole of the rail profile.

The adjustment operations are carried out basically by means of a set of suitable wedges while the fettling operations are carried out either manually or by machine.

In view of the fact that nearly all the operations are carried out manually, they have several drawbacks in that it takes a long time to carry them out, they do not always have the desired reliability and they require a qualified labor force.

In order to avoid these drawbacks, the applicant has proposed, in the French patent application No. 77 21157 filed on July 8, 1977, which corresponds to U.S. Pat. No. 4,176,777, a device which makes it possible to carry out all these operations more rapidly, more reliably and with a minimum of qualified labor.

The device described in the above patent application consists of a horizontal rigid housing with open structure which can straddle the two rails while arranging, around the two ends to be joined, an access zone demarcated by the open structure of the housing; two primary jacks and two secondary jacks assembled so that they are aligned on the housing and arranged in such a manner that the two primary jacks are arranged between the two secondary jacks and each unit formed by a primary jack and a secondary jack can enclose one of the two rails to be joined; a retractable unit, for adjusting the gap size and fettling distance, carried by the housing and which can be moved between a rest position where it leans against the housing and a working position where it is situated in the access zone of the housing, the said retractable unit consisting of a frame which can be moved within the access zone of the housing in a direction parallel to that of the rails, this frame being equipped with means of locking which are able to make the frame integral with one or the other of the two rails in order to achieve an adjustment of the gap size for the joining operation and being equipped with a fettling tool which is suitable for eliminating the weld bead after the joining operation, if this operation is carried out by welding.

In the embodiment described in the abovementioned patent application, the secondary jacks are integral with the housing and the vertical adjustment of the rails is carried out by support points which are vertically adjustable and which are suitable for working together with the top of the rail head at the level of each secondary jack respectively.

This embodiment, however, has the drawback that is does not make it possible to carry out a vertical adjustment of the rails easily under any circumstances.

The aim of the present invention is to avoid these drawbacks by providing another embodiment of the device of the above patent application in order to make it possible to achieve vertical adjustment of the rails, which is characterized by the fact that each secondary press can be moved vertically in relation to the housing under the action of a jack and that two vertically adjustable support stops, which can work together with the top of the rail head, are provided between each of the two primary jacks and the secondary jack associated with it respectively.

According to the invention, each secondary jack is advantageously assembled on a vertically movable support under the action of a double action jack connected between the support and the housing.

Each support is connected to the housing by articulated links each on the support and on the housing to guarantee that each support is held in relation to the housing.

The housing of the device according to the invention is supported at each end by a bogie which has a jack which permits the displacement of the housing between a low working position and a raised transport position.

Each bogie consists of two suspended axles which not only ensure a suspension function but which also make it possible to follow the vertical deformations of the rail during adjustment operations when the housing is in the operating position.

The invention also provides for the assembly of a device or two parallel devices on a gantry crane travelling on two axles in such a manner as to be able to carry out simultaneously the adjustment operation and, if necessary the fettling operations on the two rail lengths of the same track.

Other characteristics and advantages of the invention will be better understood when the description given below is read, which refers to the attached drawings which are given solely as an example and in which.

Figure 7:
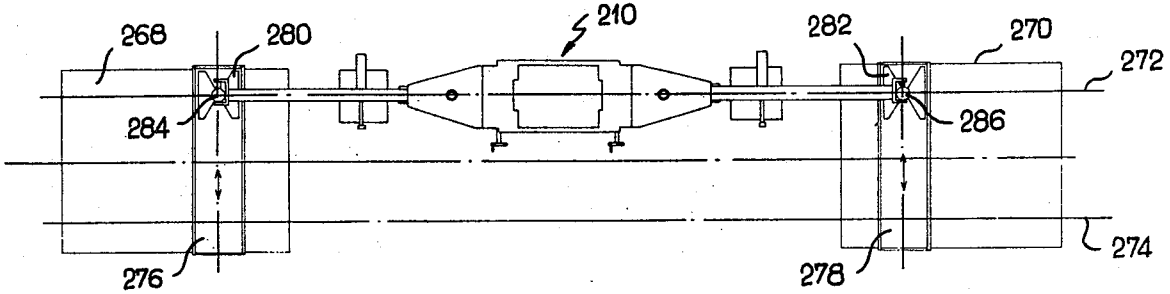
Figure 8:
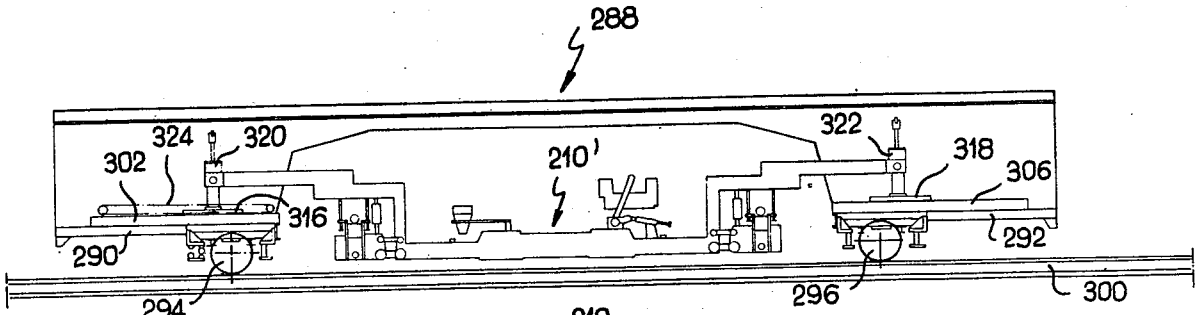
Figure 9:
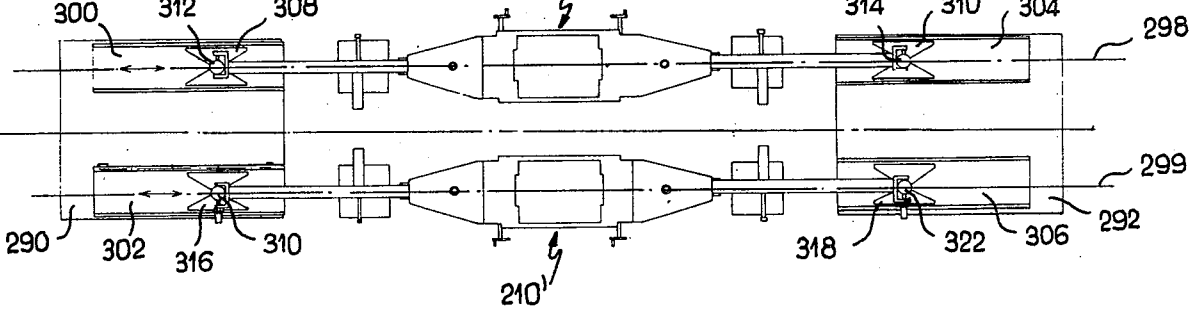

FIG. 7 is a view from the top of a gantry crane equipped with a device similar to that of FIGS. 3 to 6 and supplied with means for laterally displacing the device from one rail length to another on a railway track; and FIGS. 8 and 9 represent a side view and a top view respectively of a gantry crane equipped with two devices similar to those in FIGS. 3 to 6 in order to make it possible to carry out simultaneously operations of adjustment and/or fettling on the two rail lengths of a railway track.

In order to facilitate the description of the device of the invention, first of all the device known by the abovementioned French patent application No. 77 21157, which corresponds to U.S. Pat. No. 4,176,777, will be described with reference to FIGS. 1 and 2.

Figure 1:
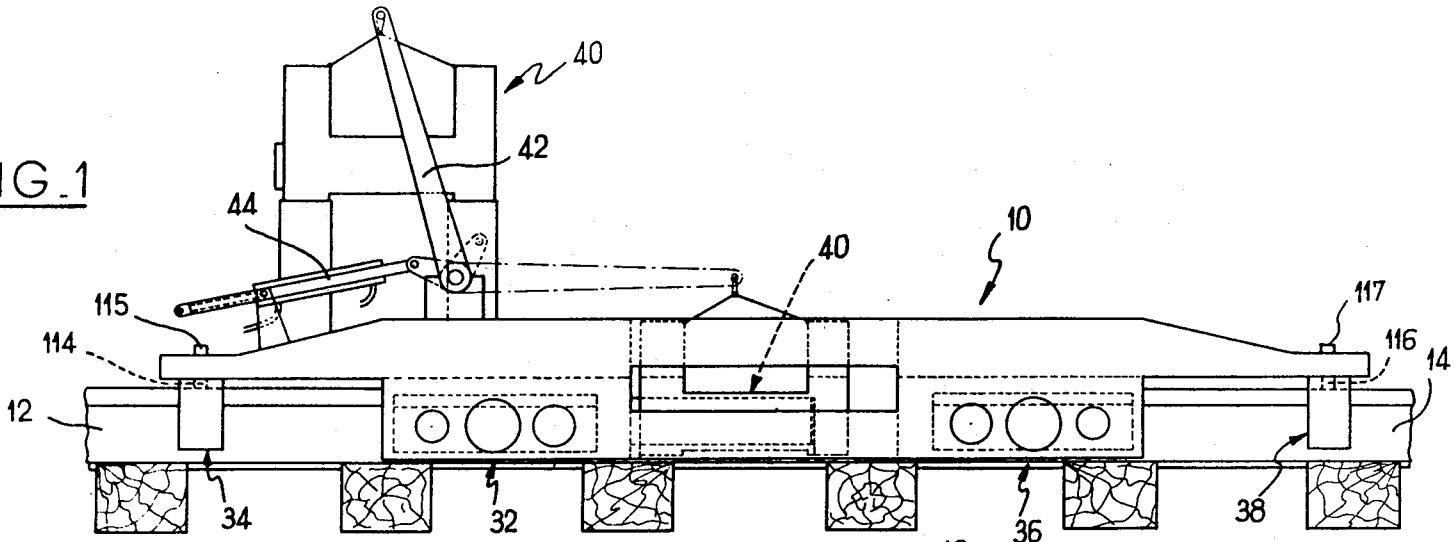
FIG. 1 is an elevation view of the front of the device of the abovementioned patent application, in which the retractable fettling unit is in the rest position.
Figure 2:
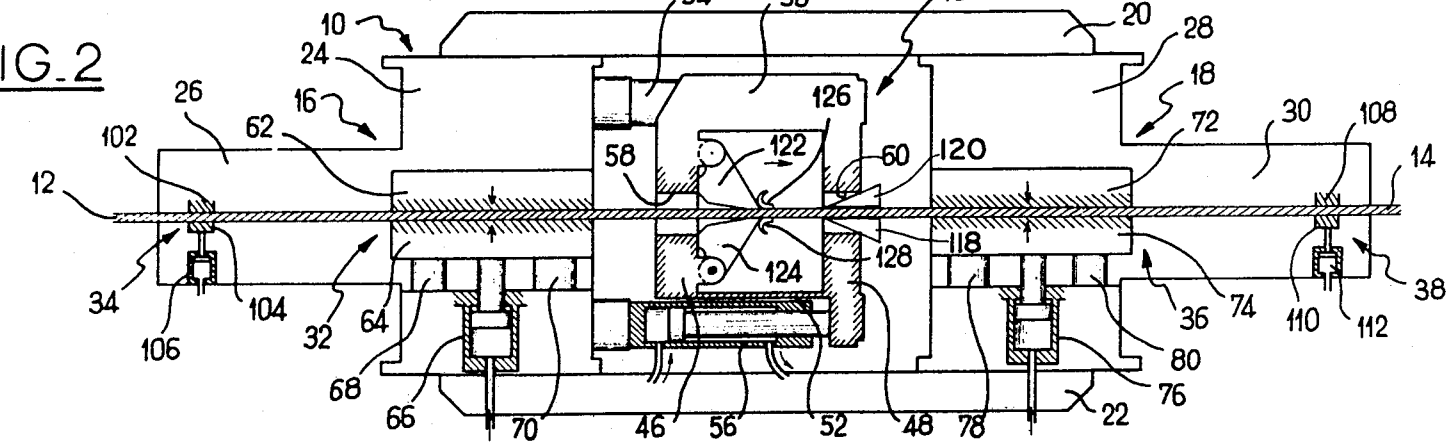
FIG. 2 is a view of the top of the device of FIG. 1, the retractable unit being in the working position in order to carry out a fettling operation.

FIGS. 1 and 2 show a device according to the abovementioned patent application, applied on a left hand rail 12 and a right hand rail 14 laid on sleepers, for which it is required to carry out joining of the free ends. The device consists of a rigid horizontal housing 10 with an open structure consisting of two straddling elements 16 and 18 fixed together by two longitudinal beams 20 and 22. The straddling element 16 consists of an inverted U element 24 suitable for straddling the rail 12 and equipped with an extension 26. Similarly, the straddling element 18 consists of an inverted U element 28, which is suitable for straddling the rail 14 and equipped with an extension 30.

The housing 10 of the device is placed in such a manner that the center of the device coincides approximately with the joining area of the two rail ends to be joined. In this manner, the open structure of the housing which consists of the inside of the housing demarcated by the two inverted U shaped elements 24 and 28 and by the two longitudinal beams 20 and 22, has an access zone around the two rail ends to be joined in order to make possible the operation of adjustment, joining and, if necessary, of fettling, if the joining is carried out by welding.

The straddling element 16 is equipped with a primary jack 32 attached on the inverted U shaped element 24 and a secondary jack 34 fixed on the extension 26. Similarly, the straddling element 18 is equipped with a primary jack 36 fixed on the inverted U element 28 and a secondary jack 38 attached to the extension 30, the jacks 36 and 38 being in alignment with jacks 32 and 34.

The two primary jacks 32 and 36 are situated between the two secondary jacks 34 and 38, the primary jack 32, as well as the secondary jack 34, being intended for enclosing the left hand rail 12, the primary jack 36 and secondary jack 38 being provided in order to encompass the right hand rail 14.

The housing 10 is, moreover, equipped with a retractable unit 40 for adjustment of the gap size and fettling distance carried by two pivoting arms 42 actuated by a double action jack 44 and which can be displaced between a rest position where it is supported on the housing 10 (cf. FIG. 1) and a working position where it is situated in the access zone of the housing (position represented in dotted lines in FIG. 1 and position shown in FIG. 2).

The retractable unit is formed by a frame with two side posts 46 and 48 connected together by two longitudinal beams 50 and 52. The retractable unit 40 can be moved inside the access zone of the housing 10 under the action of two double action jacks 54 and 56, which act in a direction parallel to that of the rails, whose body is supported on the inverted U shaped element 24 of the straddling element 16 and whose rod is connected to the side post 48 of the retractable unit 40, that is, to the side post furthest from the support point of the jacks 54 and 56 on the housing 10.

The side posts 46 and 48 of the retractable unit 40 are provided respectively with a tunnel 58 and a tunnel 60 which make possible the passage of the rail 12 and that of the rail 14 respectively. The tunnels for passage 58 and 60 can receive clamping wedges 118 and 120 respectively which enable the locking of the corresponding side post on one of the rails with a view to making possible an operation of adjustment of the gap size, one of the two side posts being, moreover, provided with a retractable fettling tool 122, 124 for eliminating the welding bead formed after the joining operation, if the latter operation is carried out by welding.

The primary jack 32 has a fixed jaw 62 which is adjustable in the horizontal plane and which can be supported against one side of the rail 12, (core or rail head) and of a movable jaw 64 which can be moved horizontally and perpendicularly to the rail 12 and which can come into support against the other side of the rail 12, the movable jaw 64 being subjected to the action of a single action jack 66 whose purpose is to bring it close to the jaw 62 and the action of two return springs 68 and 70 whose purpose is to withdraw it from the fixed jaw 62. As a variant, the jack 66 can have double action and the springs 68 and 70 can be eliminated.

Similarly, the primary jack 36 has a fixed jaw 72 which can be adjusted in the horizontal plane and which can be supported against a side of the rail 14 (core or rail head) and a moving jaw 74 which can be moved horizontally and perpendicularly to the rail 14, and which can be supported against the other side of the rail 14, the movable jaw 74 being subjected to the action of a single action jack 76 whose purpose is to bring it close to the fixed jaw 72 and to the action of two returning springs 78 and 80 whose purpose is to withdraw it from the fixed jaw 72. As a variant, the jack 76 can have double action and the springs 78 and 80 can be eliminated.

The secondary jack 34 has a fixed or movable jaw 102 and a movable jaw 104 which can be moved horizontally and perpendicularly to the rail 12 under the action of a double action jack 106. Similarly, the secondary jack or press 38 includes a fixed or moving jaw 108 and a moving jaw 110 which can be displaced horizontally and perpendicularly to the core of the rail 14 under the action of a double action jack 112.

The housing 10 is, moreover, equipped with two vertically adjustable points of support 114 and 116 which can work respectively with the top of the rail head 12 and with the top of the rail head 14 at the level of the secondary jack 34 and 38. The support points 114 and 116 can be adjusted respectively by means of heads 115 and 117 which can be actuated by a suitable key. On clamping of the primary jacks and secondary jacks, these support points come up against the top of the rail head and hence work with the primary jacks in order to carry out a slight lifting of the rail ends upwards.

If the gap size between the two ends to be welded is not suitable, then adjustment of this gap size is carried out.

To do this the retractable unit 40 is lowered by means of the jack 44 to bring it into the working position.

If it is a question of increasing the gap size, only the primary jack 36 and the secondary jack 38 which encompass the right rail 13 are unclamped, the left hand rail 12 remaining clamped by means of the primary jack 32 and the secondary jack 34.

Hence the side post 48 of the retractable unit 40 is locked on the right hand rail 14 by means of suitable wedges and then the jacks 54 and 56 are actuated in such a manner that the frame formed by the two side posts 46 and 48 and by the two longitudinal beams 50 and 52 is moved from the left to the right (direction of FIG. 2). This displacement of the frame and consequently of the side posts 48 causes the withdrawal of the right hand rail 14 in relation to the left hand rail 12, which remains stationary, and consequently the increase of the gap size. It is then sufficient to lock again the jacks 36 and 38, to withdraw the jacks 54 and 56 from the retractable unit and to bring the latter into the rest position by means of the jack 44.

If it is a question of reducing the gap size, only the primary jack 32 and the secondary jack 34, which clamped the left hand rail 12 are unclamped, the right hand rail 14 remaining clamped by means of the primary jack 36 and the secondary jack 38. Hence the side post 46 of the retractable unit 40 is locked on the left hand rail 12 by means of the said wedges and subsequently the jacks 54 and 56 are actuated in order to cause the displacement of the frame and consequently of the side post 46 from the left to the right (direction of FIG. 2). This movement causes the approach of the left hand rail 12 in relation to the right hand rail 14, which remains stationary, and consequently the reduction of the gap size. It is then sufficient to lock again the jacks 32 and 34, to withdraw the jacks 54 and 56 of the retractable unit and to bring the latter into the rest position by means of the jack 44.

Since the two rails 12 and 14 are suitably adjusted and held clamped by the jacks 32,34,36 and 38, the joining of the ends is then carried out in a conventional manner either by welding or by fishplates.

The device according to the invention will now be described with particular reference to FIGS. 3 to 6.

Figure 3:
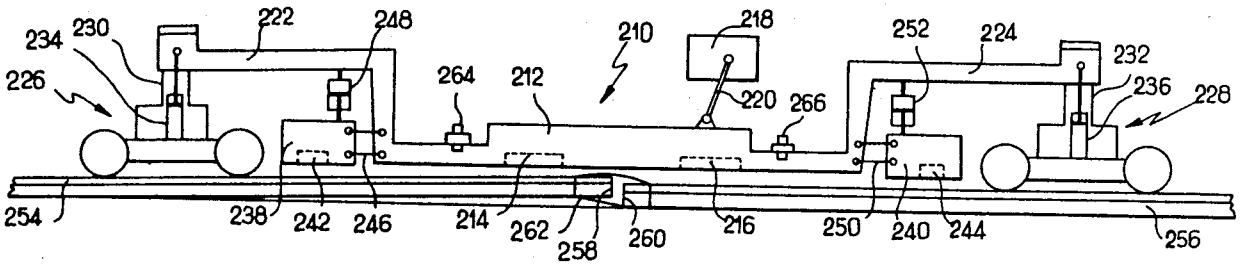
FIGS. 3 to 6 represent a side view of a device according to the invention carried on two bogies during four successive phases of one adjustment operation.
Figure 4:
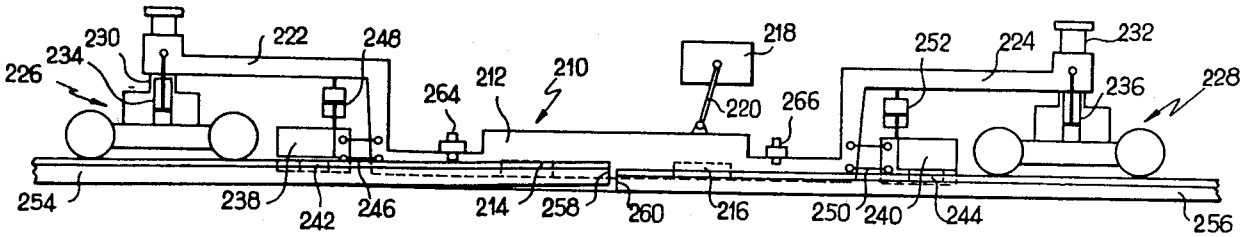

FIG. 3 shows a device according to the invention, designated by the general reference 210. This device consists of a housing 212 with open structure which demarcates an access zone and which is equipped with two primary jacks 214 and 216 as described previously with reference to FIGS. 1 and 2.

This housing is also provided with a retractable unit 218 for adjustment of the gap size, and fettling distance carried by an arm 220 and which can be moved between a rest position where it is supported on the housing and a working position where it is situated in the access zone of the housing. This retractable unit has all the characteristics of the retractable unit 40 of FIGS. 1 and 2. The housing 212 is provided with two ends 222 and 224 whose purpose is to support the housing by means of two respective bogies 226 and 228. These two bogies each consist of two suspended axles and a column 230 or 232 which permits both the pivoting of each end of the housing on its corresponding bogie as well as the adjustment of the height of the housing on its corresponding bogie as well as the adjustment of the height of the housing in relation to the bogie. For this purpose, double action jacks 234 and 236 are provided respectively on the bogies 226 and 228 in order to make it possible to modify the height of the housing in relation to the bogies. Moreover, one of the bogies is provided with a motor (not shown) to make possible the autonomous displacement of the device on the railway.

Moreover, the housing is provided with two supports 238 and 240 each of which is equipped with an end jack 242 or 244. The support 238 is connected to the housing 212 by rods 246 and by a vertical double action jack 248. Similarly, the support 240 is connected to the housing 212 by rods 250 and by a double action vertical jack 252.

In the position shown in FIG. 3, the housing is in a high position, or transport position, which makes possible the free displacement of the device on a left hand rail 254 and a right hand rail 256 from which the sleepers had previously been removed, for which it was necessary to join the respective ends 258 and 260. A provisional strapping 262 was installed between the ends 258 and 260 to make the passage of the device possible.

In the position of FIG. 3, the device is situated in a position which is such that the center of the housing is situated in the zone for joining of the two rail ends. The housing 212 is, moreover, provided with two support stops 264 and 266, which are vertically adjustable, which can operate respectively with the top of the rail head 254 and the head of the rail 256 between, on the one hand the primary jack 214 and the secondary jack 242 and, on the other hand, the primary jack 216 and secondary jack 244. These ends consist of a simple screw system to guarantee their adjustment in the vertical position; this adjustment will in general be pre-established for a type of rail and can be modified in the case of changing of the type of rail.

Figure 5:
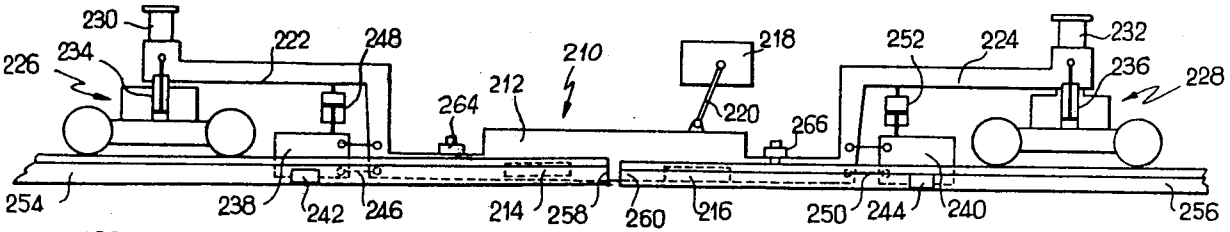
Figure 6:
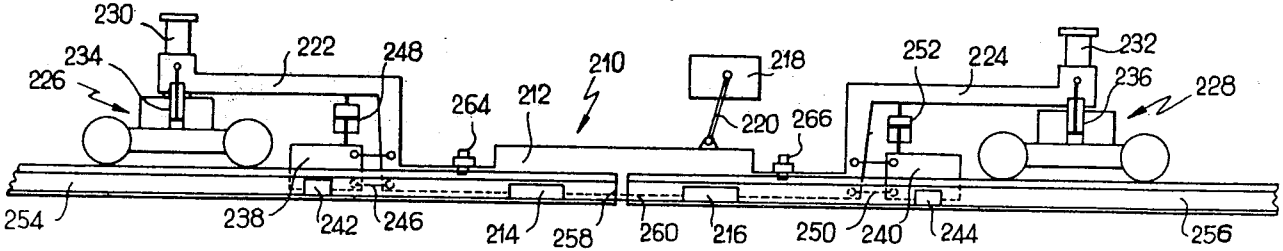

Once the device is centered on the joining position, the temporary fishplate 262 is removed and the jacks 234 and 236 are actuated in such a manner as to lower the housing 212 and to cause the stops 264 and 266 to come into contact with the rails 254 and 256. In the example shown in FIGS. 3 to 6, the end 258 is found to be raised in relation to the end 260 so that the stop 264 is first of all supported on the top of the rail head 254 causing progressively the bending of the rail 254 (FIG. 4) and so that the stop 266 is then supported on the top of the rail head 256 (FIG. 5).

Once the jacks 234 and 236 are sufficiently retracted, the device is situated in the low position, the suspensions of the bogies 226 and 228 are slackened and the weight of the device is transferred onto the stops 264 and 266 is order to make the two rails bend. The jacks 248 and 252 are actuated in order to bring the secondary jacks 242 and 244 into a suitable position and these jacks are locked on the sides of the rails 254 and 256. Then by actuating the jacks 248 and 252 the ends 258 and 160 can be raised or lowered independently by means of a "lever effect" by means of the stops 264 and 266 (see FIG. 6).

Once the vertical adjustment of the rails is thus carried out, the adjustment of the gap size is carried out by means of the unit 218 as was stated as a reference to the devices of FIGS. 1 and 2. When this adjustment is carried out the primary jacks 214 and 216 are then actuated in such a manner as to hold the rails in the joining position, the secondary jacks still being held in position and this joining is carried out by fishplating or by welding and additionally a fettling operation is carried out in the latter case.

The primary jacks 214 and 216 and the secondary jacks 242 and 244 are then unclamped and the device is then brought into the high position, or transporting position. Also the supports 238 and 240 are brought up by action on the jacks 248 and 252. The device can then be moved towards another joining zone.

The two bogies also include means which make it possible to displace the housing laterally in order to make it possible to carry out the joining both to the right and to the left of the track, these means being achieved, for example, as described below in referring to FIG. 7.

FIG. 7 shows a gantry crane consisting of two platforms 268 and 270 held fixedly together and each including a single axle (not shown) to make it possible for the gantry crane to move on the two lengths of rails 272 and 274 of a railway.

The platforms 268 and 270 are each equipped respectively with slides 276 and 278 arranged horizontally and laterally in relation to the direction of the rails. The two slides each receive with sliding motion a trolley 280 and 282 which is used to support a device 210 according to the invention, similar to that of FIGS. 3 to 6, by means of two columns 284 and 286 respectively which make possible the adjustment in the height of the device 210 in relation to the gantry crane.

The trolleys 280 and 282 can be moved by suitable means (jacks, chain transmissions etc . . . ) in order to make it possible to place the device 210 as desired either above the length of rails 272, or above the length of rails 274. The device is then used as described previously with reference to FIGS. 2 to 6.

FIGS. 8 and 9 show a gantry crane 288, identical to that of FIG. 7, consisting of two platforms 290 and 292 kept fixed together and each having a single axle 294 and 296 in order to make it possible for the gantry crane to move on the two rail lengths 298 and 299 of a railway track.

The platform 29 is equipped with two horizontal slides 300 and 302 arranged parallel and above the rail lengths 298 and 299. The platform 292 is also equipped with two horizontal slides 304 and 306 arranged parallel and above the rail lengths 298 and 299.

The slides 300 and 304 slide with the respective trolleys 308 and 310 which support a device 210 similar to that of FIGS. 3 to 6 by means of two columns 312 and 314 respectively which permit the adjustment of the height of the device 210 in relation to the gantry crane.

In a similar manner, the slides 302 and 306 slide with trolleys 316 and 318 which support a device 210', which is identical with the device 210, by the means of two columns 312 and 314 respectively which permit the adjustment of the height of the device 210' in relation to the chassis.

The trolleys 310 and 318 are assembled with free sliding on their respective slides while the trolleys 308 and 316 can be moved along their respective slides by suitable means. Hence FIG. 8 shows a chain transmission 324 which makes it possible to achieve the displacement of the trolley 316 on its slide 302. Hence adjustment and/or fettling operations can be carried out simultaneously on the two rail lengths 298 and 299. In the case in which the respective joining zones of the two rail lengths, 298 and 299 are not exactly facing one another, it is sufficient to move one or the other of the devices 210 and 210' or both at the same time along the support slides.

The device of FIGS. 3 to 6 can be derailed, that is moved laterally from the track. To do this it is sufficient to raise the housing 212 by means of the jacks 234 and 236, to place in position the elements of the rails perpendicularly to the railway track, to retract the jacks 234 and 236 completely in such a manner that the integral rollers of the housing (not shown) act upon the rail elements and the two bogies 236 and 238 are raised above the railway track.

The device of the invention can be used within the framework of the laying or restoring of railway tracks. It is of course understood that the invention is not limited to the embodiment specifically described and shown and that variants in detail can be introduced without going outside the framework of the invention.

What is claimed is:

1. An improved apparatus for adjusting the alignment and gap size defined between two rail butt ends of the type in which a rigid housing straddles the two rails and provides an access area around the two rails; a first pair of presses attached in alignment to the housing; a second pair of presses also attached in alignment to the housing and arranged in such a manner with respect to the first pair of presses that the first pair of presses are situated between the second pair of presses to form two units each of which unit is formed by one of the first pair of presses and one of the second pair of presses and each of which units can clamp one of the two rails to be connected respectively; a retractable unit for the adjustment of the size of the gap defined between the two rail ends movably mounted on the rigid housing, the retractable unit movable between a rest position where it is supported on the housing and a working position where it is situated in the access area of the housing, and including a frame mounted thereon, which, when the retractable unit is in the work position, is movable in a direction parallel to that of the rails, removable locking means for securing the frame to one or the other of the rails in order to achieve an adjustment of the gap size before the connection of the rails, and a fettling tool mounted thereon for eliminating weld beading when connection of the rails has been carried out by welding, wherein the improvement comprises: a pair of vertically mounted jacks operatively secured to the second pair of presses to permit vertical movement of the second pair of presses independent of the rigid housing, and a pair of support stops mounted respectively on said rigid structure between the first press and second press of each unit and vertically adjustable relative to the rigid housing for cooperation with the top of the rails, whereby vertical adjustment of the rails can be effected by the selected vertical movement of the second pair of presses and the adjustable support stops.

2. Apparatus as claimed in claim 1 in which each second press is assembled on a support which can be moved vertically under the action of one of the jacks which is connected between the support and the housing.

3. Apparatus as claimed in claim 2, in which each support is connected to the housing by rods which are hinged on the support and on the housing.

4. Apparatus as claimed in claim 1 in which, the housing is supported at each of its ends by a bogie comprising a jack which enables displacement of the housing between a low operating position and a high transport position to be carried out.

5. Apparatus as claimed in claim 4, in which each bogie comprises two suspended axles for following the vertical deformations of the rail during adjustment of the rail when the housing is straddling two rail butt ends.

6. The apparatus according to claim 1 in which the rigid housing is supported on a gantry crane by means of height adjustable columns which are carried by respective trolleys located on slides to enable lateral displacement of the apparatus from one length of rail to the other.

7. The apparatus according to claim 1 in which two of said apparatus are supported on a gantry crane by means of height adjustable columns which are carried by respective trolleys located on slides to enable displacement of said two apparatus such that one apparatus is along one rail length and the other apparatus is along the other rail length respectively of a railway track.

* * * * *